US005423131A

United States Patent [19]

Shibano

[11] Patent Number: 5,423,131

[45] Date of Patent: Jun. 13, 1995

[54] APPARATUS FOR DRYING CLEANED WORKPIECES

[76] Inventor: Yoshihide Shibano, 1629-1-12, Oyama-cho, Machida-shi, Tokyo, Japan

[21] Appl. No.: 151,025

[22] Filed: Nov. 12, 1993

[30] Foreign Application Priority Data

Nov. 13, 1992 [JP] Japan ..... 4-303701

[51] Int. Cl.[6] ..... F26B 25/00

[52] U.S. Cl. ..... 34/105; 34/107; 34/237; 34/233

[58] Field of Search ..... 34/437–441, 34/225, 233, 104–107, 203, 204, 216, 217, 237, 238, 195, 197, 164, 92

[56] References Cited

U.S. PATENT DOCUMENTS

| | | | |
|---|---|---|---|
| 3,574,952 | 4/1971 | Lee, Jr. | 34/105 |
| 3,729,832 | 5/1973 | Lund | 34/105 |
| 3,977,091 | 8/1976 | Hortig et al. | 34/105 |
| 5,131,171 | 7/1992 | Nguyen | 34/174 |
| 5,293,697 | 3/1994 | Kawakami | 34/92 |

FOREIGN PATENT DOCUMENTS 4-209515 7/1992 Japan .

*Primary Examiner*—Denise L. Gromada
*Attorney, Agent, or Firm*—Paul A. Guss

[57] ABSTRACT

Plate-like workpieces such as thin ceramic plates which are ultrasonically cleaned are housed in a tray having an air-permeable bottom plate and a plurality of air-impermeable sidewall plates extending from peripheral edges of the bottom plate. To dry the cleaned workpieces, the tray is placed in a drying tank and supported on a support base on the bottom of the drying tank at an inclined attitude. The drying tank is combined with a hot-air duct which is detachably coupled to respective edges of the sidewall plates of the tray when the tray is supported on the support base. The hot-air duct supplies hot air into an interior space of the tray which is surrounded by the sidewall plates. A suction duct is coupled to the bottom plate of the tray supported on the support base and draws hot air supplied from the hot-air duct from within the interior space through the bottom plate.

5 Claims, 3 Drawing Sheets

APPARATUS FOR DRYING CLEANED WORKPIECES

BACKGROUND OF THE INVENTION

1. Field of the Invention

The present invention relates to an apparatus for drying cleaned plate-like workpieces by removing a cleaning solution from the workpieces.

2. Description of the Prior Art

There has been known an apparatus for drying workpieces, such as small thin ceramic plates for use as crystal oscillators or capacitors, which have been cleaned by a cleaning apparatus using a cleaning solution such as water. In such an apparatus, a plurality of workpieces are placed in a tray having an air-permeable bottom, and hot air is applied from above the tray and drawn from below the tray so that the hot air forcibly passes through the spaces between the workpieces. The hot air is heated to such a temperature that it can evaporate the cleaning solution that is attached to the workpieces.

The hot air which is supplied from a hot-air duct can not only evaporate moisture from the exposed surfaces of the workpieces in the tray, but also remove moisture in spaces or gaps between those workpieces which may overlap each other as the hot air enters those gaps.

Before the workpieces are dried by the drying apparatus, the workpieces are cleaned by the cleaning apparatus. If the workpieces are small thin lightweight ceramic plates for use as crystal oscillators or capacitors, for example, and cleaned ultrasonically while being supported on a tray and immersed in a cleaning solution, then when the tray is taken out of the cleaning solution, the workpieces in the tray tend to be stacked into blocks in which they stick closely together through the attached cleaning solution. The gaps between the workpieces in each of the blocks are very small, with the cleaning solution firmly retained in the gaps. The gaps between the blocks of workpieces are larger than the gaps between the workpieces, and may sometimes be large enough for them to be interconnected vertically in the tray.

When the cleaned workpieces are dried by the drying apparatus, hot air supplied from the hot-air duct tends to pass through the larger gaps between the blocks of workpieces, rather than being uniformly applied to the workpieces in the blocks. Since the heat of the hot air cannot efficiently be transmitted to the workpieces sticking together in the blocks, it takes a relatively long period of time for all the workpieces to be fully dried.

SUMMARY OF THE INVENTION

It is an object of the present invention to provide an apparatus for drying a number of cleaned plate-like workpieces efficiently, quickly, and reliably.

To achieve the above object, there is provided in accordance with the present invention an apparatus for drying cleaned plate-like workpieces, comprising a tray for housing a plurality of plate-like workpieces therein, the tray having an air-permeable bottom plate and a plurality of air-impermeable sidewall plates extending from peripheral edges of the bottom plate, a support base for supporting the bottom plate of the tray at an inclined attitude, a hot-air duct detachably coupled to respective edges of the sidewall plates of the tray which is supported on the support base, for supplying hot air into an interior space of the tray which is surrounded by the sidewall plates, and a suction duct coupled to the bottom plate of the tray supported on the support base, for drawing hot air supplied from the hot-air duct from within the interior space through the bottom plate.

After the workpieces are cleaned, the tray housing the workpieces is supported on the support base at an inclined attitude. The workpieces that are stacked in the tray move sideways out of the stacked condition, allowing an attached cleaning solution to drop off the workpieces. Since the amount of cleaning solution attached to the workpieces is reduced, the workpieces can be dried within a relatively short period of time. Even if the workpieces are stacked and clustered in blocks in the tray while they are being cleaned, the blocks are broken when the tray is inclined. Therefore, the gaps between the blocks are eliminated, and hot air drawn from the hot-air duct into the suction duct can pass thoroughly through the gaps between the workpieces. Since the heat of the hot air is uniformly transferred to the workpieces, the workpieces can be dried efficiently, quickly, and reliably.

The support base may comprise a support frame for intimately contacting the peripheral edges of the bottom plate of the tray, and legs supporting the support frame at an inclined attitude, the suction duct being integrally joined to the entire peripheral edges of the support frame.

The tray may have a pair of grips mounted on outer surfaces of two respective opposite sidewall plates thereof. The apparatus may further comprise lifting/lowering means for lifting the tray away from and lowering the tray toward the support base, the lifting/lowering means having a pair of hooks for engaging the grips, respectively, to support the tray and releasing the grips upon downward movement beyond a position in which the tray is supported on the support base. Therefore, the tray may be supported on the support base easily when the tray is lowered by the lifting/lowering means.

The hot-air duct may be suspended from the lifting/lowering means for upward movement with respect to the lifting/lowering means when the hot-air duct is coupled to the tray which is supported on the support base. Thus, even if the lifting/lowering means is further lowered when the tray is supported on the support base, the lifting/lowering means is allowed to move downwardly relative to the hot-air duct, keeping the hot-air duct stably coupled to the tray.

Each of the plate-like workpieces may comprise a thin ceramic plate for use as a quartz oscillator or a capacitor.

The above and other objects, features, and advantages of the present invention will become apparent from the following description when taken in conjunction with the accompanying drawings which illustrate a preferred embodiment of the present invention by way of example.

BRIEF DESCRIPTION OF THE DRAWINGS

FIG. 4(*b*) is a fragmentary vertical cross-sectional view of workpieces in the tray which is inclined.

DETAILED DESCRIPTION OF THE PREFERRED EMBODIMENT

Figure 1:
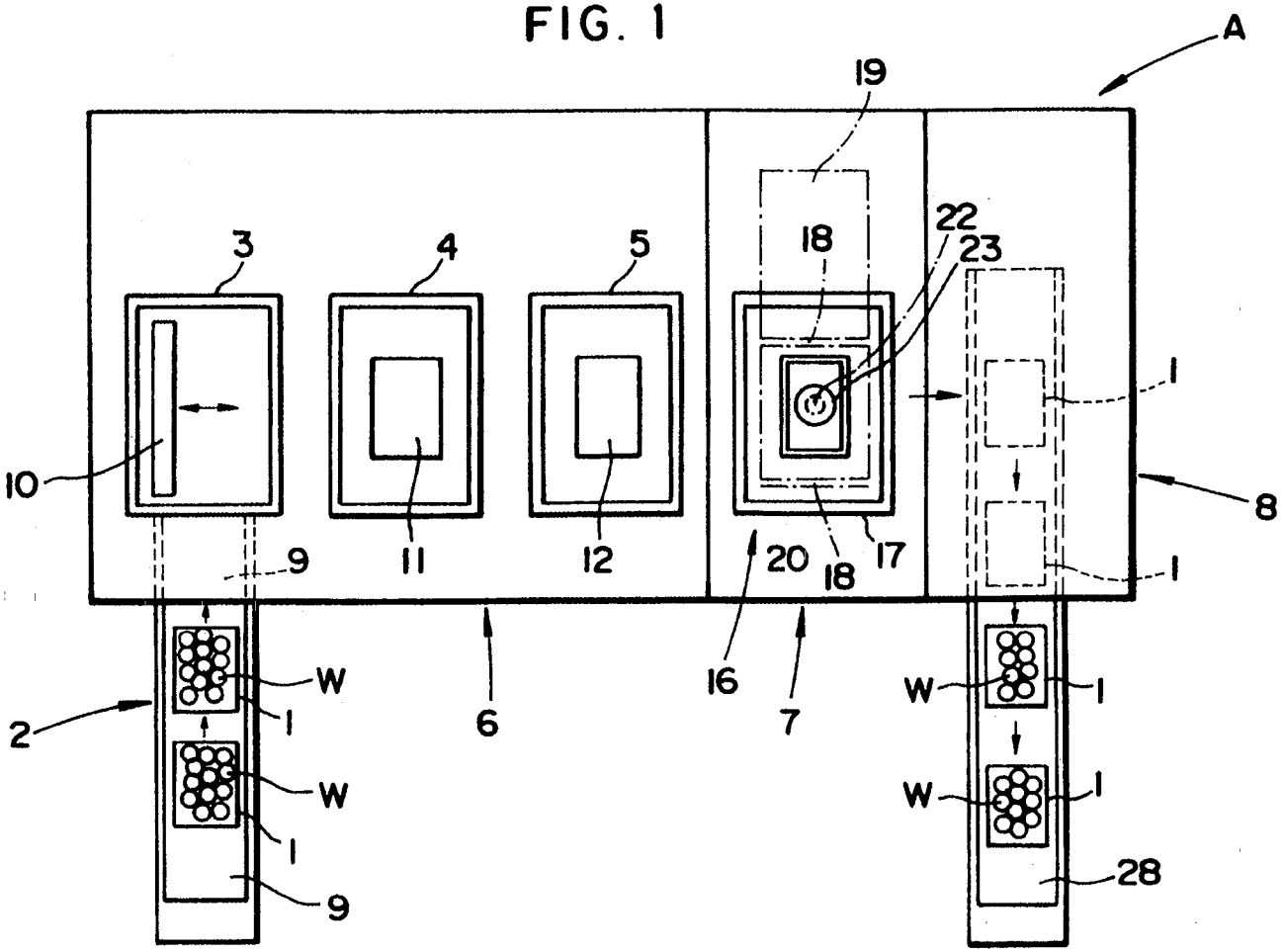
FIG. 1 is a plan view of a cleaning system which incorporates a drying apparatus according to the present invention.

As shown in FIG. 1, a cleaning system A for cleaning plate-like workpieces W such as thin ceramic plates for use as crystal oscillators or capacitors generally has a loading section 2 for successively loading trays 1 each containing a number of workpieces W, a cleaning section 6 including a preliminary cleaning tank 3 for cleaning workpieces W contained in trays 1 that are successively introduced from the loading section 2, an ultrasonic cleaning tank 4 for ultrasonically cleaning workpieces W contained in trays 1, and an ultrasonic rinsing tank 5 for ultrasonically rinsing workpieces W contained in trays 1, a drying section 7 for drying workpieces W that have been cleaned by the cleaning section 6, and an unloading section 8 for unloading trays 1 containing workpieces W that have been discharged from the drying section 7.

The loading section 2 includes a loading conveyor 9 for supporting and successively charging a plurality of trays 1 into the preliminary cleaning tank 3 of the cleaning section 6.

The preliminary cleaning tank 3 has a shower nozzle 10 for spraying a cleaning solution downwardly over workpieces W contained in a charged tray 1 to preliminarily cleaning the workpieces W.

The ultrasonic cleaning tank 4 is filled with a deaerated cleaning solution, and houses an ultrasonic vibrator 11 supported on its bottom. The ultrasonic vibrator 11, when actuated, generates cavities in the cleaning solution in the ultrasonic cleaning tank 4. When the generated cavities collapse, they produce shock waves which are applied to the workpieces W thereby cleaning the workpieces W.

The ultrasonic rinsing tank 5 is filled with tap water, and houses an ultrasonic vibrator 12 supported on its bottom, the ultrasonic vibrator 12 being identical with the ultrasonic vibrator 11. The ultrasonic vibrator 12, when actuated, generates cavities in the water in the ultrasonic rinsing tank 5. When the generated cavities collapse, they produce shock waves which are applied to the workpieces W thereby rinsing the workpieces W.

Figure 3:
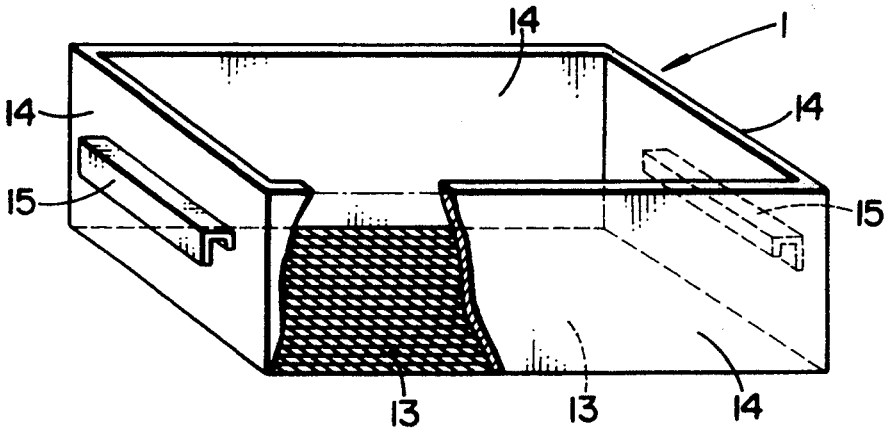
FIG. 3 is a perspective view, partly broken away, of a tray used in the drying apparatus.

As shown in FIG. 3, each of the trays 1 comprises an air-permeable square-shaped bottom plate 13 in the form of a mesh-like network of wires, four air-impermeable sidewall plates 14 projecting upwardly from respective edges of the bottom plate 13, and a pair of grips 15 mounted on the outer surfaces of two respective opposite sidewall plates 14. Workpieces W can be taken into and out of the trays 1 through their upper open sides. The air-permeable square-shaped bottom plate 13 may alternatively comprise a punched plate with a number of perforations.

Transport means (not shown) for transporting the trays 1 are provided between the preliminary cleaning tank 3 and the ultrasonic cleaning tank 4 and also between the ultrasonic cleaning tank 4 and the ultrasonic rinsing tank 5. Lifting/lowering means (not shown) are also provided above the preliminary cleaning tank 3, the ultrasonic cleaning tank 4, and the ultrasonic rinsing tank 5, for lowering trays 1 transported by the transport means into the tanks 3, 4, 5 and lifting trays 1 out of the tanks 3, 4, 5 upon elapse of certain periods of time.

Figure 2:
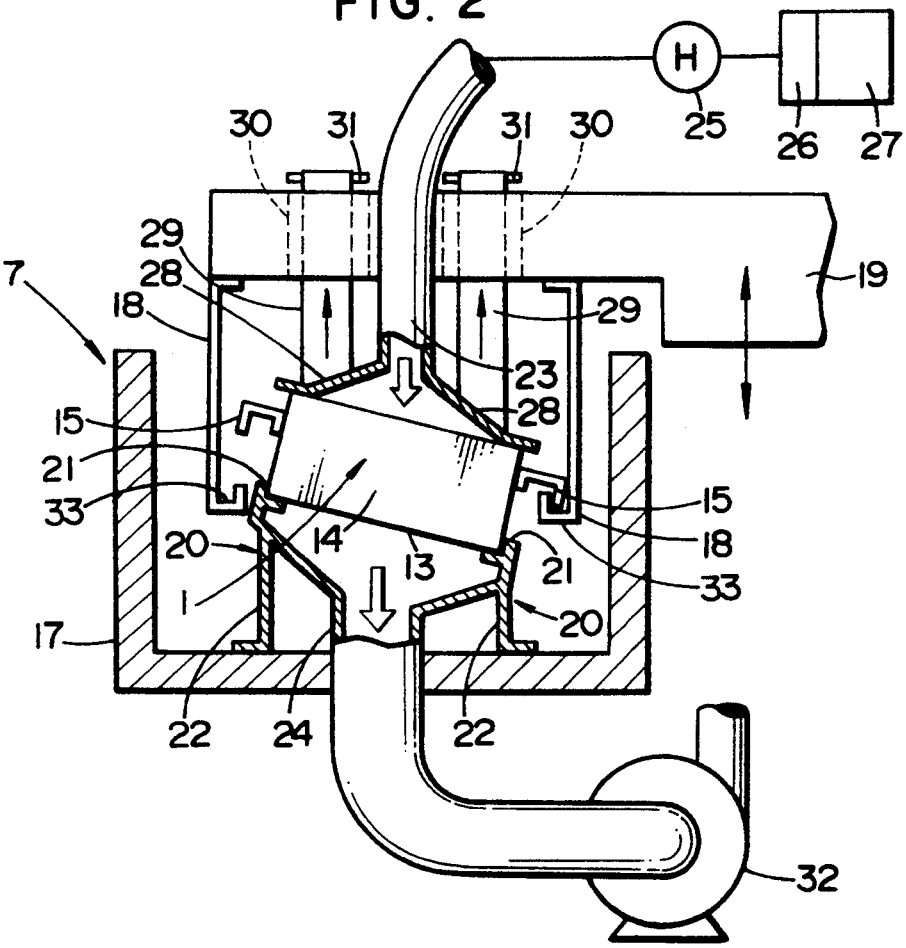
FIG. 2 is an enlarged fragmentary side elevational view, partly in cross section, of the drying apparatus.

The drying section 7 includes a drying apparatus 16 according to the present invention. As shown in FIG. 2, the drying apparatus 16 comprises a drying tank 17 for housing a tray 1, a pair of horizontally spaced vertical support arms 18 positioned above the drying tank 17 for supporting the tray 1, a horizontal lifting/lowering arm 19 which supports the support arms 18 extending downwardly therefrom and can be lifted and lowered by an actuator (not shown) between a position to which the tray 1 has been fed and a position inside of the drying tank 17, and a support base 20 disposed on the bottom of the drying tank 17 for supporting the bottom plate of the tray 1 at its peripheral edges that has been lowered into the drying tank 17 by the lifting/lowering arm 19. The lifting/lowering arm 19 operates with the lifting/lowering means above the tanks 3, 4, 5 to lift and lower the trays 1. The support base 20 has a centrally open support frame 21 for supporting only the peripheral edges of the bottom plate 13 of the tray 1. The support frame 21 is fixedly mounted on the upper ends of legs 22 of different lengths and hence inclined for supporting the tray 1 at an inclined attitude.

A hot-air duct 23 for supplying hot air extends vertically through and is vertically movably mounted on the lifting/lowering arm 19. A suction duct 24 is disposed centrally below the support frame 21 for drawing hot air supplied from the hot-air duct 23.

The hot-air duct 23 is connected through a heater 25 to an air blower 27 which has an air filter 26. The heater 25 heats air supplied from the air blower 27 through the air filter 26 to a temperature that is high enough to evaporate the cleaning solution. A downwardly flaring hood 28 is attached to the lower end of the hot-air duct 23 between the support arms 18 for vertical movement into and out of abutting engagement with the full peripheral edges of the upper opening of the tray 1 that is supported on the support base 20. The hood 28 is vertically movably suspended on the lifting/lowering arm 19 by a pair of parallel support bars 29 extending upwardly from the hood 28. The support bars 29 are vertically movable along guides 30 in the lifting/lowering arm 19. When lowered, the downward movement of the support bars 29 is limited by stops 31 attached to the respective upper ends of the support bars 29 upon engagement of the stops 31 with the guides 30. The hood 28 is inclined in the same direction as the support frame 21 for snugly abutting against the upper surface of the tray 1 that is supported on the support frame 21.

The suction duct 24 has an upper end integrally joined to the entire peripheral edges of the support frame 21 and an opposite end located outside of the drying tank 17 and coupled to a suction device 32. When the tray 1 is supported on the support base 20, the bottom of the tray 1 is coupled to the upper end of the suction duct 24.

Operation of the cleaning system A will be described below.

First, a tray 1 housing a number of workpieces W is introduced into the cleaning section 6 by the loading conveyor 9 of the loading section 2. In the cleaning section 6, the workpieces W in the tray 1 are successively preliminarily cleaned by the preliminary cleaning tank 3, ultrasonically cleaned by the ultrasonic cleaning tank 4, and ultrasonically rinsed by the ultrasonic rinsing tank 5.

After the workpieces W have been cleaned in the cleaning section 6, the tray 1 which contains the workpieces W that are wet with water is transferred to the support arms 18 suspended from the lifting/lowering arm 19 in the drying section 7. When the tray 1 is supported on the support arms 18, the grips 15 of the tray 1 are engaged by respective hooks 33 on the respective lower ends of the support arms 18. The lifting/lowering arm 19 is then lowered to lower the tray 1 into the drying tank 17 until the tray 1 is supported on the support base 20. When the tray 1 is supported on the support base 20, since the support frame 21 is inclined, the tray 1 on the support base 20 is inclined as shown in FIG. 2. At this time, the hooks 33 are lowered beyond a position in which the tray 1 is supported on the support base 20, releasing the grips 15 of the tray 1, which is now fully supported obliquely on the support base 20.

At the same time that the support arms 18 release the tray 1 upon descent of the lifting/lowering arm 19, the hood 28 on the lower end of the hot-air duct 23 abuts against the upper edges of the sidewall plates 14 of the tray 1 by gravity.

The hot-air duct 23 and the suction duct 24 are now held in communication with each other through the tray 1 that is sandwiched between the hot-air duct 23 and the suction duct 24. Now, hot air is supplied from the hot-air duct 23 into the tray 1. Inasmuch as the bottom plate 13 of the tray 1 is permeable to air and the sidewall plates 14 thereof are not permeable to air, the workpieces W housed in the tray 1 are exposed to only hot air supplied from the hot-air duct 23, while being isolated from ambient air surrounding the sidewall plates 14 of the tray 1.

While hot air is being supplied to the tray I from the hot-air duct 23, the supplied hot air is forcibly drawn from within the tray 1 by the suction duct 24.

Figure 4A:
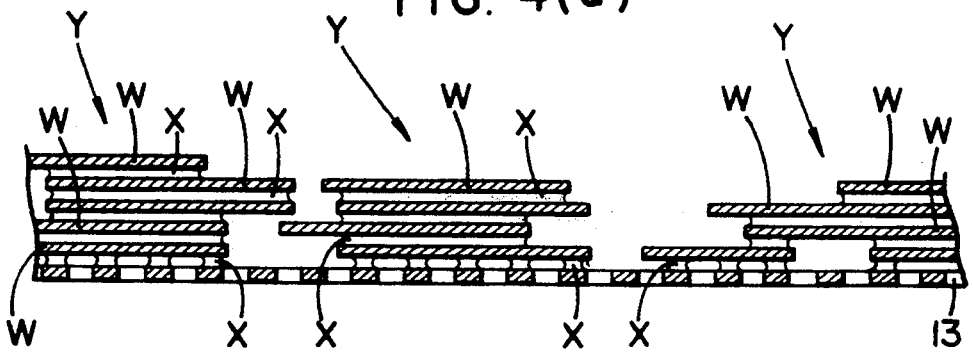
FIG. 4(*a*) is a fragmentary vertical cross-sectional view of workpieces in the tray which lies horizontally.
Figure 4B:
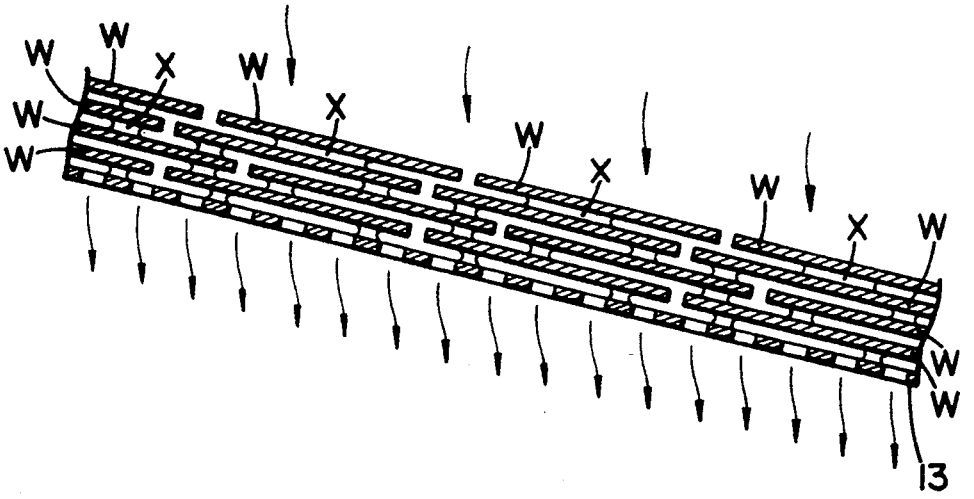

When the tray 1 is taken out of the cleaning solution in the ultrasonic cleaning tank 4, the workpieces W housed in the tray 1 that have been ultrasonically cleaned in the ultrasonic cleaning tank 4 are clustered in blocks Y in which each of the workpieces W are stacked with cleaning solution films X retained therebetween as shown in FIG. 4(*a*). At this time, the stacked workpieces W in each of the blocks Y tend to stick together on account of the cleaning solution films X retained therebetween. When the tray 1 that houses the clustered workpieces W is then placed in the drying tank 17, since the tray 1 is inclined on the support base 20, the workpieces W move sideways in their inclined plane, breaking up the blocks Y as shown in FIG. 4(*b*). The workpieces W which had become stuck together with the cleaning solution films X are loosened, allowing the excessive cleaning solution to drop from the workpieces W. Since the amount of cleaning solution attached to the workpieces W is reduced, the workpieces W can be dried within a relatively short period of time.

When the blocks Y are broken up, as described above, large gaps between the blocks Y are eliminated. Therefore, the hot air drawn from the hot-air duct 23 into the suction duct 24 can flow thoroughly through the smaller gaps between the workpieces W. As the heat of applied hot air can uniformly be transferred to the workpieces W, the workpieces W can efficiently, quickly, and reliably be dried by the applied hot air.

The hot air is supplied for a certain period of time until the workpieces W are fully dried. When the drying process is completed, the lifting/lowering arm 19 is elevated. On the ascending movement of the lifting/lowering arm 19, the grips 15 of the tray 1 are engaged by the hooks 33, and hence the tray 1 is lifted out of the drying tank 17 by the lifting/lowering arm 19. When the tray 1 is tilted back to a horizontal attitude, the hood 28 is separated from the tray 1, thereby disconnecting the tray 1 from the hot-air duct 23.

Thereafter, the tray 1 supported by the support arms 1 is discharged into the unloading section 8 by a discharging means (not shown), and then unloaded by an unloading conveyor 34 in the unloading section 8.

Although a certain preferred embodiment of the present invention has been shown and described in detail, it should be understood that various changes and modifications may be made therein without departing from the scope of the appended claims.

What is claimed is:

1. An apparatus for drying cleaned workpieces, comprising:

a tray for housing a plurality of flat workpieces therein, said tray having an air-permeable bottom plate and a plurality of air-impermeable sidewall plates extending from peripheral edges of said bottom plate;

a support base for supporting the bottom plate of said tray in a fixed position and at an inclined attitude;

a hot-air duct detachably coupled to respective edges of said sidewall plates of the tray which is fixedly supported on said support base, for supplying hot air into an interior space of the tray which is surrounded by said sidewall plates; and a suction duct coupled to said bottom plate of the tray supported on said support base, for drawing hot air supplied from said hot-air duct from within said interior space through said bottom plate.

2. An apparatus according to claim 1, wherein said support base comprises a support frame for intimately contacting the peripheral edges of said bottom plate of the tray, and legs supporting said support frame at an inclined attitude, said suction duct being integrally joined to entire peripheral edges of said support frame.

3. An apparatus according to claim 1, wherein said tray has a pair of grips mounted on outer surfaces of two respective opposite sidewall plates thereof, further comprising vertical conveying means for lifting said tray away from and lowering said tray toward said support base, said vertical conveying means having a pair of hooks for engaging said grips, respectively, to support said tray and releasing said grips upon downward movement beyond a position in which said tray is supported on said support base.

4. An apparatus according to claim 3, wherein said hot-air duct is suspended from said vertical conveying means for upward movement with respect to the vertical conveying means when said hot-air duct is coupled to the tray which is supported on said support base.

5. An apparatus according to claim 1, wherein each of said plate-like workpieces comprises a thin ceramic plate.

* * * * *